US005590785A

United States Patent [19]

Seitzinger

[11] Patent Number: 5,590,785

[45] Date of Patent: Jan. 7, 1997

[54] FURNITURE FINISH COLOR SPOT REPAIR KIT AND METHOD OF MAKING THE SAME

[75] Inventor: Richard L. Seitzinger, 10755 S. Buffalo, Chicago, Ill. 60617

[73] Assignee: Richard L. Seitzinger, Chicago, Ill.

[21] Appl. No.: 645,916

[22] Filed: May 14, 1996

Related U.S. Application Data

[62] Division of Ser. No. 567,399, Dec. 5, 1995, abandoned, which is a continuation of Ser. No. 345,949, Nov. 28, 1994, abandoned.

[51] Int. Cl.[6] ..... B44D 3/04

[52] U.S. Cl. ..... 206/575; 206/582; 206/1.8; 206/1.9; 53/447

[58] Field of Search ..... 206/582, 1.7, 1.8, 206/1.9, 229, 232, 575

[56] References Cited

U.S. PATENT DOCUMENTS

| | | | |
|---|---|---|---|
| Re. 23,322 | 1/1951 | Lazare | 206/1.9 X |
| 1,018,824 | 2/1912 | Hasburg | 206/1.9 |
| 1,193,181 | 8/1916 | Peck | 206/1.7 |
| 1,474,721 | 11/1923 | King | 206/1.7 |
| 1,484,613 | 2/1924 | Carmel | 206/1.7 |
| 2,676,428 | 4/1954 | Silver | 206/1.7 |
| 2,738,606 | 3/1956 | Klein | 206/1.7 |
| 3,428,167 | 2/1969 | Sheng | 206/1.7 |
| 3,856,136 | 12/1974 | Governale | 206/1.7 |
| 3,924,733 | 12/1975 | DeLong | 206/1.8 |
| 4,161,250 | 7/1979 | Pierce | 206/575 |
| 4,708,817 | 11/1987 | Dudnick | 206/1.7 |

OTHER PUBLICATIONS

Furniture Repair Products from Mohawk Copyright 1986

*Mohawk Finishing Products* 15th edition 1990–91 p. 80.

Star Touch–Up Service Kits p. 23.

*Primary Examiner*—Jacob K. Ackun

*Attorney, Agent, or Firm*—Russell N. Muehleman

[57] ABSTRACT

A furniture finish color spot repair kit provides soluble color elements on a palette which is in the form of a card, deck of cards or a tube. The kit is also provided with a solvent and a brush for dissolving, mixing and applying colors to a damaged area. A method of making a kit provides cutting of the cards, printing the color elements and any other desired information and packaging the cards, solvent and brush, and if desired, providing the kit with an adaptation for hanging on a display rack.

11 Claims, 2 Drawing Sheets

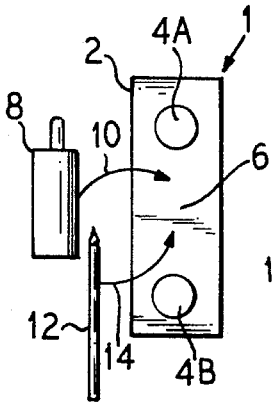
FIG. 1
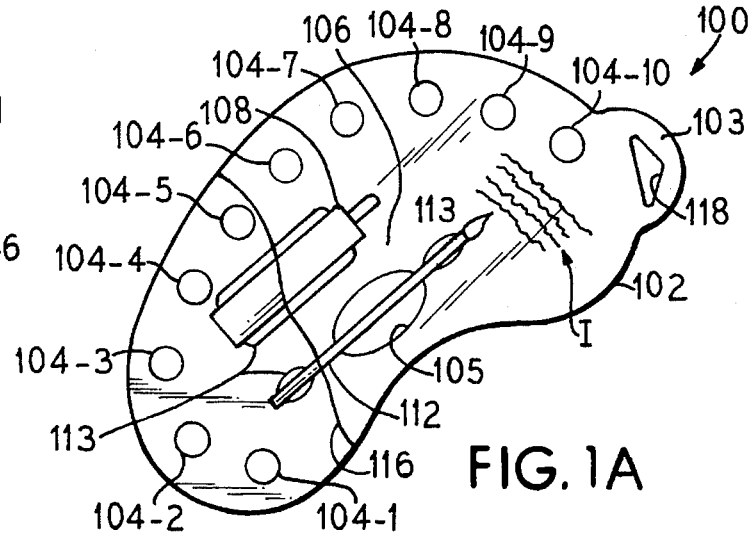
FIG. 1A
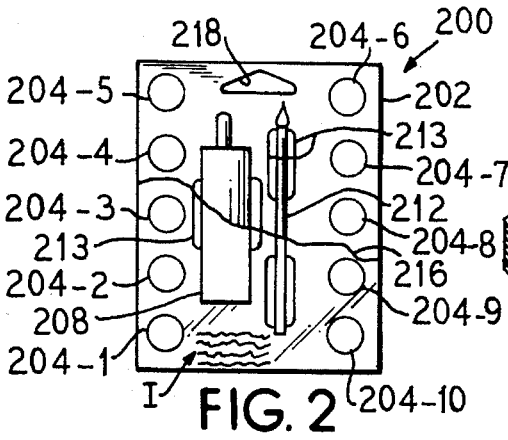
FIG. 2
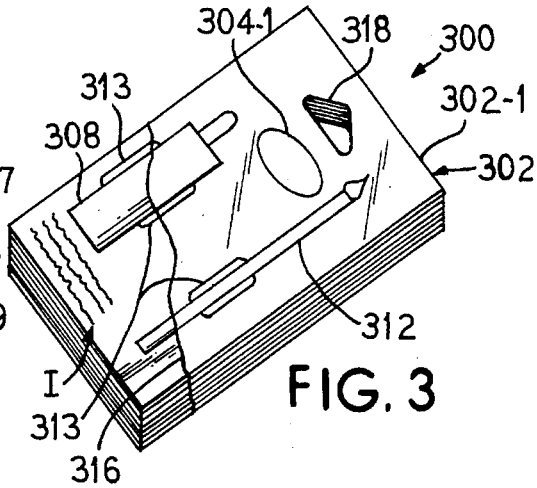
FIG. 3
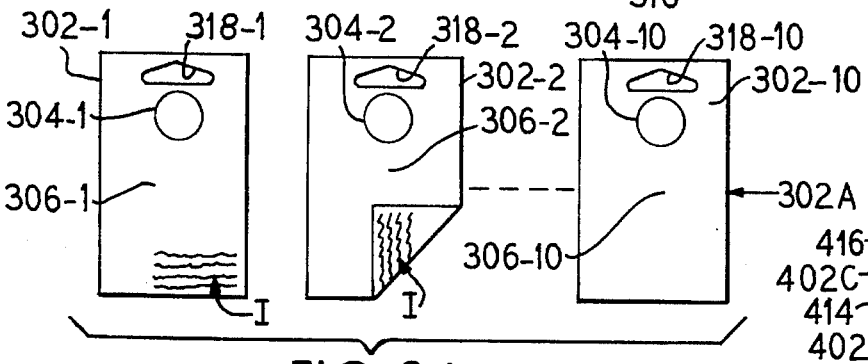
FIG. 3A
FIG. 4
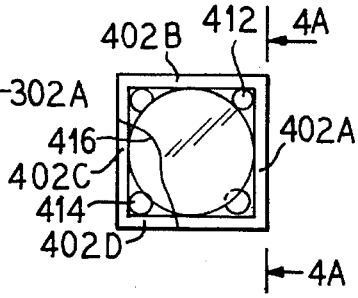
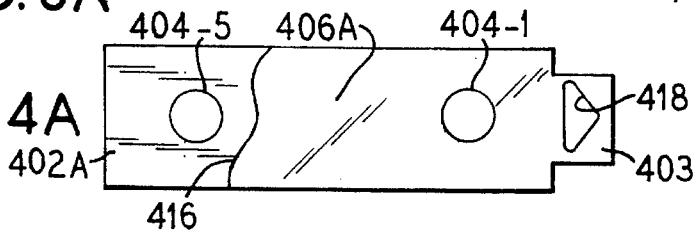
FIG. 4A FIG. 5
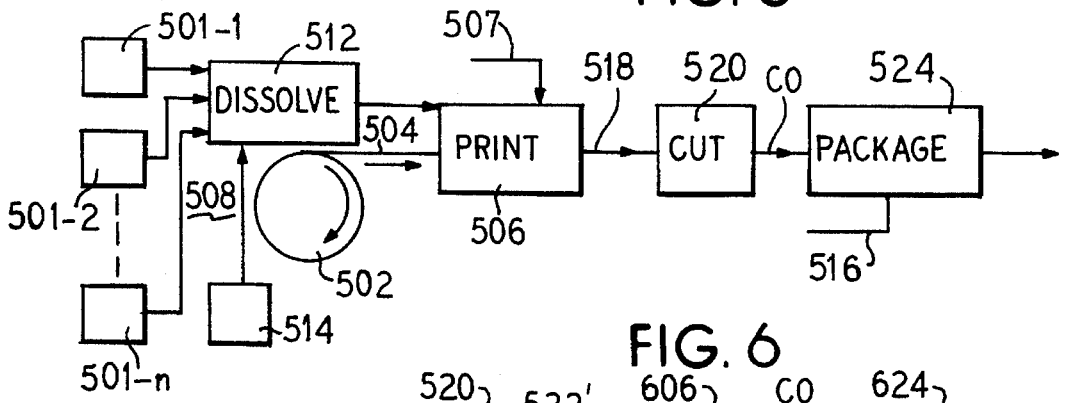
FIG. 6
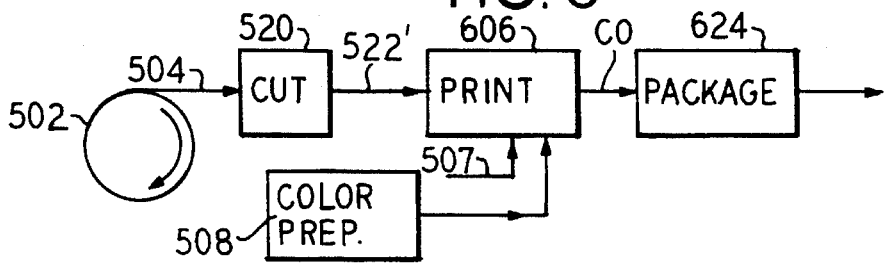
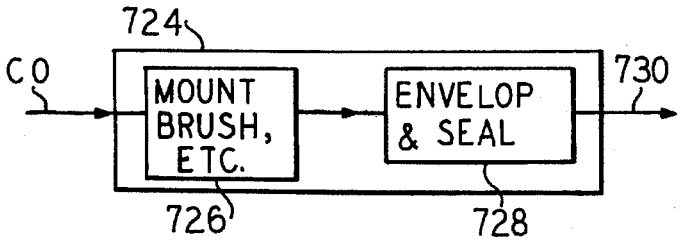
FIG. 7
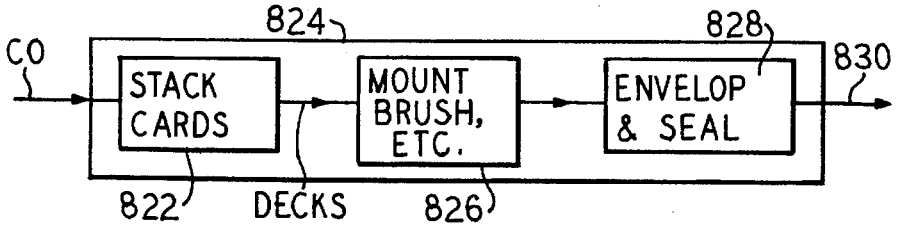
FIG. 8
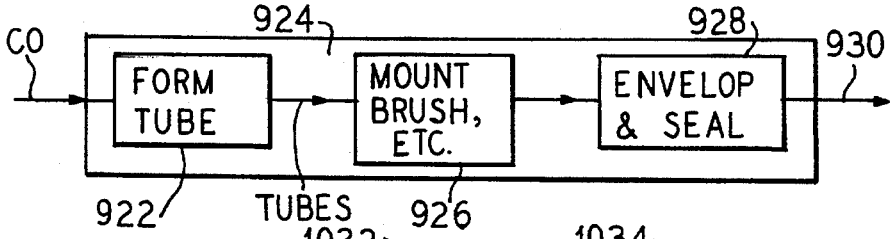
FIG. 9
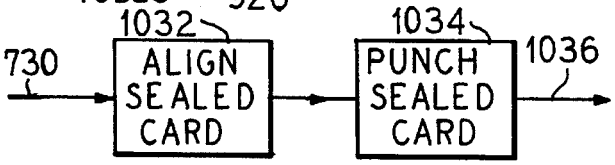
FIG. 10
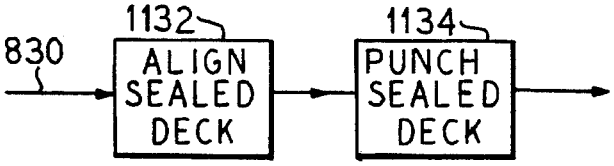
FIG. 11

FURNITURE FINISH COLOR SPOT REPAIR KIT AND METHOD OF MAKING THE SAME

This is a division, of application Ser. No. 08/567,399, filed Dec. 5, 1995, and now abandoned, which is a continuation, of application Ser. No. 08/345,949 filed Nov. 28, 1994, now abandoned.

BACKGROUND OF THE INVENTION

1. Field of the Invention

The present invention relates to a kit for touching-up, i.e. color matching, of the color of the finish of furniture which has been marred or damaged, and more specifically to the as-perfect-as-possible matching of the color of the finish furniture which has been damaged subsequent to finishing provided by the manufacturer and to a method for making the kit.

2. Description of the Prior Art

Many consumers, in fact it is safe to say most consumers, have experienced marring or damage of the finish of a piece of furniture, either by accident or by negligence. This damage can affect the color of the finish and can arise, for example, at the manufacturer during movement or packing of the item, at the wholesaler or distributor by movements during receiving, storing and shipping, at the retailer during receiving and shipping (delivery), or at the consumer's premises during delivery or house cleaning, i.e. vacuuming and the like. The question then arises as how to match the color to that of the surrounding area so as not to be noticeable. This is known in the art as spot repair.

Each manufacturer has a range of colorings which are obtained from one or a combination of colors (pigment dyes) and which can be replicated, even remote from the manufacturer's finishing shop. Admittedly, the person doing the touch-up process must have a "good eye"; but even given that qualification, an accurate color match may be created by most persons. In this connection, one may refer to *Furniture Repair Products from Mohawk*, Copyright 1986, Mohawk Finishing Products, Inc., Amsterdam, N.Y., 15$^{th}$ Edition 1990–91, for example.

It is known in the art of painting to create various hues or shades of colors by mixing paints. This covers the gamut from the professional artist using, for example, acrylics, to paint stores, hardware stores and home improvement centers with computer-matched paint tinting, and to children's paint kits. In the former, the artist mixes one color with another or others to obtain a desired "new" color. Paint stores, hardware stores and home improvement centers subject a sample of paint-to-be-matched to a color separation and evaluation process to determine the types and amounts of tinting colors to be added to and mixed with a base color in order to obtain a match. Since most house paint, interior and exterior, is based on one of two or three base colors, this works for all colors expect at the extreme dark end of the color spectrum, but when one is working with a large area, such as an entire wall or loom, color difference is not usually detectable for the walls or ceiling; furniture, however, is different in that it becomes focal.

The above techniques involve the use of a paint or color vehicle with the colors or tints (hereinafter, simply colors) themselves. With water colors, including the professional artist use and the children's water color paint kits, the vehicle, water, is separate and is used to dissolve the available colors. The combination of the water and the colors are used to satisfy the desire of the painter, as mentioned above for the professional artist, and not in a comparison to a defined existing color thereby giving rise to a unique tinting problem.

The above-cited Mohawk publication describes processes for refinishing damaged spots (spot repair) using their kits of jars of powder dye and a dissolving vehicle. The present invention is considered to be a step beyond these kits and processes, particularly in convenience to both the amateur and the professional.

SUMMARY OF THE PRESENT INVENTION

As is evident from the above, the primary object of the present invention is to provide apparatus, in the form of a kit, by which a professional or amateur furniture finish repair person may spot repair (accurately match the color of the existing finish) a marred piece of furniture.

An attendant object of the invention is to increase the accuracy of the novice (and the professional) in accomplishing color matching providing him with an easily-discernible color matching device.

The above includes spot repair of furniture finishes which are considered to be stained or painted, such as what are presently known as white-washed or pickled finishes. In other words, the invention concerns stain and paint-type finish color matching.

Another object of the invention is to provide a method of making a finish repair (spot repair) kit for achieving the foregoing objects.

Another object of the invention is to provide a method of making a color refinishing kit (spot repair kit) of the type described above, particularly as adapted for retail sale.

According to the invention, one construction of the kit includes a plurality of colors applied to a palette (card) with the colors spaced from one another adjacent an open area which may be used for mixing. The palette or card may then have instructions for use printed thereon and a container of solvent and a color applicator in the form of an application and mixing brush mounted thereto. After the container of solvent and the applicator are mounted to the card, the card may then be packaged in an outer cover, such as a transparent shrink plastic, in the form of a "blister" pack or in the form of a clam-shell packet. If the kits are to be sold at retail from a hanging display, the entire packet may be adapted for hanging on a support rod of a pegboard-type display by the provision of a hanging aperture through a marginal area of the kit.

According to the invention, also, the kit may be supplied as a deck of cards with each card having a separate color thereon, instructions printed on the front or reverse of each card, or a separate substrate, i.e. instruction card or sheet, the cards (substrates) stacked in a deck and the container of solvent and application brush mounted to the, preferably top card, the deck. Additionally, each card may have a hanging aperture therethrough for registration with the other such apertures and hanging of the deck of cards on a display rack.

Another form of the invention provides that the card is bent or folded into a tubular structure after the printing steps, the tube then serving as a container for the container of solvent and the application brush, and also for a sheet of instructions if the same is printed separately. After this, the tube is then encased in a transparent outer cover such as a transparent clam-shell pack or a transparent shrink or bubbled plastic. Packets of this type may also be adapted for hanging displays by the provision of a hanging aperture therethrough.

It may be advisable, particularly where the tube is concerned, or even for the cards, to provide a separate extending tab for supporting formation of the hanging aperture. In this case of the deck of separate color cards, this tab could be provided on just one of the cards of the deck. In such a case, particularly where a shrink or bubble-type housing is used, the transparent material need not necessarily cover such an extending tab. Also, in the case of the tube form, the tab would be provided in the initial cutting of the flat card either before or after the application of the colors and printing of instructions or other printed information, and before forming of the tube.

In using a repair kit constructed in accordance with the present invention, the refinisher will first clean the area to be repaired, then compare the color samples with the color of the finish to be replicated. This may require that he select the closest lighter color with respect to the desired color and determine if a mix of another color or colors should be used to tint or darken the selected color. Armed with this information he then applies a suitable solvent, such as clear lacquer, clear carnauba wax, alcohol, water or oil to the palette, either directly on the desired color or on a clear area, dips the brush into the solvent and into a desired color, or colors if mixing this to be done, and then applies the result to the damaged or marred area. Of course, prudent wiping with a clean cloth (Frenching) will blend the color with the surrounding area and enhance the appearance of the repair. In this connection, the artesian may employ what is known as the "French polishing" technique with a French polishing pad as described in the aforementioned Mohawk publication at pp. 5 and 6. After a short drying time, the refinished area may be further finished, i.e. lacquered, then waxed or otherwise treated as if no damage had occurred.

To produce a finish color repair kit according to the present invention, the individual colors are dissolved with an appropriate solvent, applied to a card or cards (presumed to be flat), as by printing such as done with newspaper supplements or spraying through a mask, dried, instructions and other desired information and/or graphics printed, and then, if a three-dimensional tubular structure is desired, folded or bent and secured to form the above mentioned tubular structure before packaging. If a flat structure is desired, instructions for use may be printed on the front or reverse of the flat card or cards or on a separate sheet. If a tubular structure is desired, the use instructions may be printed on a separate sheet and folded or rolled for insertion within the tube along with a container of solvent and an applicator brush before application of the outer cover.

BRIEF DESCRIPTION OF THE DRAWINGS

Other objects, features and advantages of the present invention will be readily apparent from the following description of best mode embodiments thereof, taken in conjunction with the accompanying drawings, although variations and modifications may be affected without departing from the spirit and scope of the novel concepts of the disclosure, and in which:

FIG. 1 is a schematic illustration of a finish color repair kit constructed in accordance with the present invention;

FIG. 1*a* is a top plan view of one embodiment of the invention shown in a stereotype form of an artist's palette;

FIG. 2 is a top plan view, similar to that of FIG. 1, showing an embodiment of a kit constructed in accordance with the present invention with a palette in the form of a rectangular card;

FIG. 3 is a top plan view of an embodiment of the invention with a plurality of palettes, shown in the form of a deck of cards;

FIG. 3*a* is a plan view of individual palettes or cards of the deck of FIG. 3;

FIG. 4 is an end view of an embodiment of the invention, with the palette shown as a tubular structure, along with a container of solvent, a brush and an instruction sheet mounted within the tube;

FIG. 4*a* is a plan view of one side of the tubular structure of FIG. 4, as viewed in the direction 4A—4A of FIG. 4;

FIG. 5 is a schematic representation of a general method of making the finish color repair kits of FIGS. 1–4A;

FIG. 6 is a schematic representation of another general method of making the finish color repair kits of FIGS. 1–4A;

FIG. 7 is a schematic representation of a packaging stage for making the embodiments of FIGS. 1A and 2 in accordance with the teachings of FIGS. 5 and 6;

FIG. 8 is a schematic representation of a packaging stage for making the embodiment of the invention as shown in FIGS. 3 and 3A in accordance with the teachings of FIGS. 5 and 6;

FIG. 9 is a schematic representation of a packaging stage for making the embodiment of the invention shown in FIGS. 4 and 4A in accordance with the methods of FIGS. 5 and 6;

FIG. 10 illustrates a continuation of the process for punching the individual cards of FIGS. 1A, 2, 4, 4A when an extending tab is not covered with a sealing material; and FIG. 11 is similar to claim 10, but directed to punching hanging apertures through the decks of FIG. 3.

Inasmuch as the embodiments of kits of the invention are suitable for and intended for sale in retail environments such as paint stores, hardware stores and home improvement centers, the packaging is structurally adapted for display and stocking on pegboard hangers or for box "open cut" display in which the elements placed on display to essentially stand on end or lean on end in an outer carton which has been cut at the top and part of an end to reveal the contents of the carton and provide access thereto.

DESCRIPTION OF THE PRESENTLY PREFERRED EMBODIMENTS

Embodiments of the Kits

FIG. 1 illustrates the basic form of a kit constructed in accordance with the invention generally at 1 in which a palette or card 2 carries at least two colors to be mixed, here the colors 4A and 4B spaced apart and each adjacent an open mixing area 6. A source or container of a mixing vehicle or solvent 8 is shown along with an applicator in the form of a tint mixing and application brush 12. The container 8 and the brush 12 are to be mounted on the card 2 as indicated by the respective arrows 10 and 14. Depending on the type of solubility required by the colors, the vehicle may be a clear lacquer, water, alcohol, oil or a carnauba wax as is well known in the art. The vehicle may be applied to the mixing area and the brush used to pick up vehicle and then pick up (and mix) colors before applying the desired result to the area being repaired.

For lacquer as an example, the vehicle or dissolving source may be a spray can of lacquer, a bottle of lacquer with an eye dropper, brush (or straw), or a dropper-type bottle of lacquer. As is well known in the art, carnauba wax compounds generally include mixtures of alkaline dyes and carnauba wax in a paste form and may be applied by a brush or a stick or knife-type applicator element.

Although there is a variety of such different types of colors, the following description is directed to lacquer-soluble colors.

Referring to FIG. 1A, a furniture finish color touch-up (spot repair) kit is generally illustrated at 100 as a card 102, here in the kidney-shaped form of an artist's palette including a thumb hole 105 and an extending tab 103. A plurality of individual colors 104-1–104-10 are applied spaced apart on the card 102 adjacent an open mixing area 106.

As a packaged kit, a spray can of clear lacquer 108 is mounted on the card 102 along with a mixing and application brush 112, and adhered thereto, for example, by way of a peel-off adhesive 113. Instructions for use, graphic information (decoration) and other information may be printed on the card 102 as indicated at I on the face of the card or on the reverse thereof.

After mounting of the clear lacquer solvent 108 and the brush 112, the card 102, carrying the container 108 and the brush 112 is enclosed in a, preferably transparent, cover 116.

As shown in FIG. 1A, the card 102 includes the extending tab 103 through which a hanger hole 118 is punched. The hanger hole 118 is to receive a hanging rod of a pegboard-type display rack for a hanging display of the kit. If the cover 116 is dimensioned so as not to enclose the tab 103, the hole 118 may be punched prior to packaging. If, however, the tab 103 is to be covered with the packaging material, the hanger hole 118 is punched after application of the material 116. Of course, a different placement of certain color areas, such as the colors 104-9 and 104-10 may provide sufficient room for the hanger hole 118 in the card proper without the need for an extended tab 103. Such an association of elements is illustrated in FIGS. 2, 3 and 3A.

Well-known packaging techniques may be employed using, preferably, transparent material in a package of the type known as a "blister" pack or a "clam-shell" pack.

Referring to FIG. 2, a kit 200 is formed using a rectangular card 202 as a palette. A plurality of colors 204-1–204-10 are applied to the card 202 spaced apart adjacent an open mixing area 206 which carries an eye-dropper type bottle 208 of liquid lacquer and a brush 212 mounted thereto by way of an adhesive 213.

In FIG. 2, hanger hole 218 is punched through the transparent cover 216 and the card 202 proper.

FIGS. 3 and 3A illustrate a kit 300 constructed in accordance with the present invention in the form of a deck of cards 302. In FIG. 3A, the deck of cards 302 is illustrated as individual cards 30-1–302-10, each carrying a respective color 304-1–304-10 adjacent a respective open-mixing area 306-1–306-10.

Each of the cards 302-1–302-10 includes a respective hanging aperture 318-1–318-10 which registers along with a similar aperture in a transparent cover (316, FIG. 3) to form a collective hanging aperture 318.

The kit of FIG. 3 also includes a vehicle source 308 in the form of a spray can or bottle of clear lacquer and a mixing and application brush 312 mounted on the uppermost card 302-1 by a peel-off adhesive 313. Afterward, these elements are encased in a transparent cover 316.

As shown in FIG. 3, instructions for use I may be printed on the top card 302-1 of the deck 300. This is also illustrated in FIG. 3A. These instructions I may also be printed on the reverse of each card as shown for the card 302-2, or on a separate sheet or card.

FIGS. 4 and 4A illustrate another embodiment of the invention generally at 400 in the form of a rectangular tube 402A–402D which also serves as a kit container for the mixing vehicle container 408 and a mixing and application brush 412 mounted in the tube and, if separately provided, a sheet of instructions for use 414 also mounted in the tube. The kit container (tube) 402A–402D is closed and the tube is sealed by a transparent cover 416.

The tube may be of any suitable cross-sectional shape (rectangle, circle, triangle, pentagon, etc.), but is shown here as having a square cross-sectional shape formed by the plurality of sides 402A–402D.

As is evident, the shape of the tube cross-section and the peripheral length with respect to the dimensions of the color areas along the peripheral length determines the length of the tube and the placement of the color areas about and along the tube for the desired number of color areas of a kit. For example, assuming flat sides with two color areas per side, FIG. *4a* shows a four-sided construction which, when of appropriate length, will accommodate at least eight color areas (only areas 404-1 and 404-5 being shown). The same length of the tube and length and width of the sides forming a pentagon cross-sectional tube will accommodate at least ten color areas, etc.

Colors and colors for tinting may be selected from a variety of colors such as in the following Color Schedule A. These are stain powders offered under the designation "Star Match-O-Blend Powder" by the firm Star Finishing Products, Inc, 360 Shore Drive, Hinsdale, Ill. 60521. Star designates use for spot color replacement on all types of finishes and suitability for use with Star frenching materials, two-minute touch-up and graining liquid.

COLOR SCHEDULE A

| Mfg. # | Color Designation |
|---|---|
| 1 | Brown Mahogany |
| 2 | Red Mahogany |
| 4 | Dark Walnut |
| 7 | Red Maple |
| 8 | Champagne |
| 11 | Limed Oak |
| 13 | White |
| 14 | Black |
| 15 | Limed Walnut |
| 16 | Light Gray |
| 17 | Dark Gray |
| 18 | Deep Mahogany |
| 19 | Orange Red Maple |
| 20 | Straw |
| 21 | Extra Dark Walnut |
| 22 | Extra Dark Mahogany |
| 23 | Orange Maple |
| 24 | Oak |
| 25 | European Brown |
| 26 | Antique Green |
| 27 | Cantonese Yellow |
| 28 | Cardovan Mahogany |
| 29 | Bright Red Mahogany |
| 30 | Medium Walnut |
| 31 | Non-Fading Red |
| 32 | Jet Nigrosine |
| 33 | Green |
| 34 | Blue |
| 35 | Yellow |
| 36 | Red |
| 41 | Provincial Mahogany |
| 42 | Fawn |
| 43 | Early Modern |
| 44 | Provincial Walnut |
| 50 | Burnt Sienna |

-continued

| COLOR SCHEDULE A | |
|---|---|
| Mfg. # | Color Designation |
| 51 | Burnt Umber |
| 52 | Raw Sienna |
| 53 | Raw Umber |
| 54 | Van Dyke Brown |
| 55 | Yellow Ochre |
| 56 | Vermilion Red |
| 57 | New Light Walnut |
| 58 | New Light Brown Maple |
| 59 | New Dark Brown Maple |
| 60 | New Blonde |
| 61 | New Wheat |
| 62 | New Prima Vera |
| 63 | New Nutmeg |
| 64 | Universal Walnut |

The following Color Schedule B provides an assortment of colors offered by the firm Mohawk Finishing Products, Inc., 302 S. Stewart Ave., Addison, Ill. 60101, under the designation "Blendal Powder Stain" (Pigment Type) stated in the above-referenced publication to provide best results when applied with their LACOVER® French polish padding finish, and to be compatible with various other padding agents, "French Polish", lacquer, shellac, varnish and synthetic finishes.

| COLOR SCHEDULE B | |
|---|---|
| Mfg. # | Color Designation |
| 401 | Almond |
| 224 | Black |
| 222 | Blonde |
| 414 | Blue |
| 051 | Blue Prussian |
| 052 | Ultramarine |
| 8359 | Brown Cherry |
| 249 | Brown Perfect |
| 1478 | Brown Van Dyke |
| 408 | Cherry |
| 160 | Cherry Fiddletone |
| D404 | Fruitwood Dark |
| L404 | Fruitwood Light |
| 413 | Green |
| 056 | Green Medium |
| 229 | Mahogany Brown |
| 227 | Mahogany Dark Red |
| 269 | Mahogany Drexel |
| 218 | Mahogany Light Red |
| 273 | Mahogany Modern |
| 246 | Mahogany Red |
| 226 | Mahogany Sheraton |
| 236 | Maple Brown |
| 240 | Maple Colonial |
| 256 | Maple Dark |
| 8374 | Maple Dark Brown |
| 8370 | Maple Medium |
| 1515 | Maple Medium Salem |
| 208 | Maple Reddish |
| 225 | Maple Rock |
| 406 | Maple Salem |
| 411 | Nutmeg |
| 6355 | Oak Charter |
| 7021 | Oak Extra Dark |
| 220 | Oak Golden Dark |
| 415 | Oak Golden Dark |
| 2052 | Oak Medium |
| 1522 | Oak Statesman |
| 238 | Orange |
| 060 | Orange Yellow |
| 1516 | Pine |
| 242 | Red |
| 050 | Red Ameri. Vermillion |
| 285 | Red Biscayne |

-continued

| COLOR SCHEDULE B | |
|---|---|
| Mfg. # | Color Designation |
| 042 | Red Venitian |
| 275 | Seafoam |
| 476 | Sienna Burnt |
| 1435 | Umber Burnt |
| 0143 | Umber Raw |
| 156 | Walnut American |
| 207 | Walnut Brown Med. |
| 209 | Walnut Dark Extra |
| 234 | Walnut Dark Medium |
| 206 | Walnut Light |
| 0205 | Walnut Medium |
| 400 | Walnut Swedish |
| 233 | Wheat |
| 202 | White |
| 412 | White Antique |
| 1506 | White Provincial |
| 203 | Yellow Canary |
| 041 | Yellow French Ochre |
| 058 | Yellow Light |
| 059 | Yellow Medium |

Embodiments of the Methods of Making the Kit

Referring to FIGS. 5–9, methods for making the kits of 1A, 2, 3 and 4, 4A are schematically illustrated.

In FIG. 5, a method is generally illustrated at 500 in which a web 504 of cardboard-type paper stock is fed from a roll 502 of such stock to a printing station 506. The printing station also receives colors to be applied to the web 504 from a plurality of color sources 510-1–510-n which are part of a color preparation station 508 including a dissolving station 512 at which separately mixes the individual colors are separately mixed with a suitable solvent from a solvent source 514 to a consistency for printing or spraying the same through a mask onto the web 504. The printing station 506 is also supplied with a printing ink from an ink feed 507 for printing information including instructions I for use of the kit. The printing ink is used to print such instructions (and any other desired graphics or information) on the front or back of the card as illustrated in FIGS. 1A, 2, 3 and 3A. The tubes in FIGS. 4 and 4A may be so printed, although it is expected that the embodiment of FIGS. 4 and 4A will have a separate sheet of printed instructions 414.

The printing station 506 outputs a color-bearing, (possibly printed) web at 518 to feed a cutting station 520 which produces the particular individual cards 102, 202, 302 or 402, the type depending on the final shape of the kit. These cards are sent to a kit packaging station 524 for packaging of the kits in a transparent sealing material 516 (or clam shell packs)in accordance with the particular sealing material 106, 206, 306, 406 of FIGS. 1A, 2, 3 or 4.

FIG. 6 illustrates a similar method which also produces cards of the desired type 102, 202, 302 or 402 to a packaging station 524 which is also fed by an ink feed 507 and by a roll 516 of packaging or sealing material (or clam shell packs), again in accordance with the material 106, 206, 306, 406 of FIGS. 1A, 2, 3 and 4.

FIGS. 7–12 illustrate packaging techniques for the various types of cards of the above finish color repair kits.

FIG. 7 illustrates a packaging process 724 for receiving color-bearing printed cards from either of the outputs CO of FIGS. 5 and 6, respectively. Here, the particular solvent containers 108, 208 and brushes 112, 212 of each kit of FIGS. 1A and 2 are positioned on the respective cards at a mounting station 726, adhered thereto by an adhesive 113, 213. The kits is then enveloped in a packaging or sealing material 516 (116, FIG. 1A; 216, FIG. 2; claim shell pack).

Advantageously, the punching of the apertures 118, 218, 418 may be accomplished while cutting the cards at the cutting station 520 in FIGS. 5 and 6 if the card is not to be later covered with the transparent sealing material in the area of the aperture 118, 218. If, however, this area is enveloped with the transparent packaging material, a separate punching may be provided at a punching station (1034, FIG. 10). When a clam-shell type package is used, the hanging aperture may be preformed in the clam-shell pack itself so that it may not be necessary to punch through the entire kit.

FIG. 8 illustrates a method suitable for packaging the embodiment of FIGS. 3 and 3A. In FIG. 8, the cards 302-1–302-10 may be received at a stacking station 822 at the input CO after which each of the decks 300 has a solvent container 308 and a brush 312 mounted thereto, as by way of the adhesive 313, FIG. 3.

In mounting the solvent container and the brush on the surface of a card 102, 202, 302, it may be advantageous, as mentioned above to releasably mount the same with small strips of a peel-away adhesive as mentioned above.

FIG. 9 illustrates a packaging process for making the kit of FIGS. 4 and 4A. Here, each card is received at a tube forming station 922 where it is bent, rolled or folded into the desired cross-sectional shape and in which the mating ends are secured together, such as by gluing. Next, the resulting tube is loaded with a container of solvent 408 and a brush 412 (FIG. 4), and with an instruction sheet 414 if instructions for use have not been printed on the exterior of the tube. The tube so loaded is then enveloped with a transparent packaging material 516 (416, FIG. 4) to cover the tube and close its open ends. Again, if the packaging material does not cover the aperture tab 403, a cutter 520 (FIGS. 5 and 6) can form the hang-up aperture 418; if, however, the tab 403 is covered by the packaging material, the aperture 418 is formed through the covered tab 403 in a further punching section 533.

According to FIG. 10, the cards 102, 202, 402 are received at an input of an alignment station 1032 for alignment with a punch and the hanging aperture is then punched in the following step 1034.

The same generally holds true in FIG. 11 with respect to the decks of cards 302 of FIG. 3 which are aligned with a punch in a step 1132 and the hanger hole 318 is then punched in a following step 1134.

Although I have described my invention by reference to specific illustrative embodiments thereof, many changes and modifications of the invention may become apparent to those skilled in the art without departing from the spirit and scope of the invention. I therefore intend to include within the patent warranted hereon all such changes and modifications as may reasonably and properly included within the scope of my contribution to the art.

I claim:

1. A furniture finish color spot repair kit for matching the color of the finish of a damaged area to that of the color of the finish surrounding the damaged area on a piece of furniture, said repair kit comprising:

base means comprising a plurality of cards each including at least one planar surface and stacked to form a deck of cards;

a plurality of individually-different, soluble furniture color elements each attached to and carried on a respective one of said planar surfaces, and each of said color elements including powder pigment furniture stain different from the powder pigment furniture stains of the other such color elements;

a solvent source mounted to said base means, said solvent source including solvent for dissolving at least one color element so that the dissolved powder pigment stain may be applied to a damaged area on a piece of furniture; and a color applicator mounted to said base means for applying the solvent to said at least one color element and the color so dissolved to the damaged area.

2. The spot repair kit of claim 1, wherein:

said color applicator comprises a brush.

3. The spot repair kit of claim 1, wherein: each of said color elements comprises a carnauba wax material including a mixture of alkaline dye and carnauba wax.

4. The spot repair kit of claim 1, and further comprising:

a cover enveloping said base means, said solvent source and said applicator.

5. The spot repair kit of claim 1, and further comprising:

aperture means defining a hanging aperture on said deck of cards for hanging said kit on a cantilever rod of a store rack.

6. A method of making a furniture finish color repair kit, comprising the steps of:

(a) separately mixing each of a plurality of individual, different powder pigment furniture stains with a solvent to form respective individual soluble colors;

(b) applying each of the plurality of different soluble colors as a color element to a respective one of a plurality of cards;

(c) stacking the plurality of cards to form a deck of cards;

(d) mounting a container of solvent and a color applicator to the deck of cards; and (e) enveloping the deck of cards, the container of solvent and the color applicator with an outer cover.

7. The method of claim 6, and further comprising the step of:

(f) prior to the step (c) of stacking the cards, printing instructions for use of the kit on at least one of the cards.

8. The method of claim 6, and further comprising the step of:

(f) printing instructions for use of the kit on a separate substrate; and wherein the step (c) of stacking the cards is further defined as (c1) stacking the separate substrate along with the plurality of cards to form the deck.

9. The method of claim 6, and further comprising the step of:

(f) punching a hanger hole through the deck of cards and the outer cover.

10. The method of claim 6, and further comprising the steps of:

(f) prior to the step (c) of stacking the cards, punching a hanger hole through each of the cards; and wherein the step (c) of stacking the cards is further defined as (c1) stacking the plurality of cards, while (c2) contemporaneously registering the hanger holes; and (g) punching a hanger hole through the outer cover in registry with the hanger holes of the deck of cards.

11. The method of claim 6, wherein:

the step (e) of enveloping is further defined as (e1) enveloping the deck of cards, the solvent container and the applicator with a cover of sufficient dimensions to extend as a tab beyond the deck of cards, and further comprising the step of (f) punching a hanger hole through the tab.

* * * * *